US007395881B2

(12) United States Patent
McKay et al.

(10) Patent No.: US 7,395,881 B2
(45) Date of Patent: Jul. 8, 2008

(54) ROLLER SUBS

(75) Inventors: Frederick Duguld McKay, Aberdeen (GB); Richard John Gilchrist, Aberdeen (GB); Colin Alexander Black, Inverurie (GB)

(73) Assignee: Hunting Cromar Limited, Aberdeen, Scotland (GB)

( * ) Notice: Subject to any disclaimer, the term of this patent is extended or adjusted under 35 U.S.C. 154(b) by 152 days.

(21) Appl. No.: 11/046,915

(22) Filed: Jan. 31, 2005

(65) Prior Publication Data

US 2005/0252655 A1 Nov. 17, 2005

(30) Foreign Application Priority Data

May 15, 2004 (GB) ..... 0410953.4

(51) Int. Cl.
*E21B 17/10* (2006.01)

(52) U.S. Cl. ..... 175/325.3; 175/325.4; 166/241.3; 166/241.7

(58) Field of Classification Search ..... 166/241.3, 166/241.6, 241.7; 175/325.3, 325.4
See application file for complete search history.

(56) References Cited

U.S. PATENT DOCUMENTS

| | | | | |
|---|---|---|---|---|
| 684,732 | A | 10/1901 | Villard | |
| 1,827,835 | A * | 10/1931 | Black | 166/241.3 |
| 2,466,239 | A | 4/1949 | Holcombe | |
| 3,572,450 | A * | 3/1971 | Thompson | 175/76 |
| 4,415,030 | A | 11/1983 | Walkow et al. | |
| 4,714,110 | A * | 12/1987 | Dysarz | 166/68 |
| 4,871,020 | A * | 10/1989 | Rivas et al. | 166/241.3 |
| 6,684,965 | B1 * | 2/2004 | Bakke | 175/99 |

* cited by examiner

*Primary Examiner*—Giovanna C Wright
(74) *Attorney, Agent, or Firm*—Robert L. Waddell; Ted M. Anthony

(57) ABSTRACT

A roller sub system for reducing friction between a tool string and a wall in a well bore for use in the oil and gas industry. The apparatus has a roller body and wheel sub system, which is configured to have removably mounted wheels of variable diameters. A plurality of different diameter wheel sets are described for mounting on the roller sub axles and orientating the system in the well bore. The wheels are fixed to the roller sub axles through a quick-release mechanism. A single apparatus can thus be employed with different diameter wheels to operate in well bores of variable diameters.

12 Claims, 3 Drawing Sheets

ROLLER SUBS

This application claims priority from United Kingdom (GB) Patent Application Number 0410953.4, filed on 15 May 2004.

FIELD OF THE INVENTION

The present invention relates to roller subs for reducing the friction between a tool string and a wall within a well bore, and in particular to a roller system with adjustable wheel diameters.

BACKGROUND OF THE INVENTION

Roller subs or skates are downhole devices which include wheels which contact a wall of the well bore to assist in moving the device and more particularly, the tool string to which it is attached, through a well bore. Typically tool strings pass through the well bore under the influence of gravity. However, when the well bore is deviated, particularly towards the horizontal, gravity causes the string to fall to the lower side of the well bore. In this location the string can stick and the tools thereon can become damaged. This problem is exacerbated for wireline tool strings. Roller subs maintain the tool string away from the well bore wall while the wheels reduce friction between the two and thus aid in moving the tool string through the well bore.

The earliest roller subs comprise wheels located in slots around the circumference of a cylindrical body. Multiple wheels are required to prevent the body contacting the well bore wall and as a result the wheels each have a diameter approximately half that of the body.

Later designs provide larger wheels through the centre of the body. Typically there are two pairs of two wheels, with the same orientation, located through slots in the body. In order to ensure the wheels contact the lower wall of the well bore the body is weighted on one side and this, in combination with a swivel between the body and the string, causes the wheels to lie against the low side of the well bore. Alternatively a body having an elliptical or oval cross-section, with each pair of wheels mounted on the short axis as the wheels run on the longer dimension, will preferentially tip the body onto the longer dimension. This roller sub will therefore orient itself to run on the low side of the well bore.

A major disadvantage of the prior art roller subs is that the wheels are located within or through slots in the body. The wheels must therefore be of a size which fits within the slot but which protrudes sufficiently from the body to contact the well bore wall. As a result each body is designed for a single wheel diameter and thus a different roller sub is required for efficient operation in well bores of different diameters.

An object of at least one embodiment of the present invention is to provide a roller sub system whose wheel diameter can be varied.

A further object of at least one embodiment of the present invention is to provide a roller sub body to which roller wheels of variable diameters can be used.

SUMMARY OF THE INVENTION

According to a first aspect of the present invention there is provided a roller sub system for use in a tool string to reduce friction between the string and a well bore in which the string is run, the system comprising an elongate body including connector means for locating the body on the string and one or more pairs of roller wheels mounted on the body for contacting a wall of the well bore, wherein the body comprises a plurality of narrowed portions on a first plane parallel to a central longitudinal axis of the body through which are located respective axles perpendicular to the longitudinal axis, a pair of wheels being mounted an each axle and wherein each wheel includes an outward facing substantially hemispherical surface with a circumferential edge to contact the well bore wall.

As the wheels are located on outer surfaces of the body, the size of the wheels can be varied to suit the dimensions of the well bore without requiring any changes to the body or removal of the roller sub from the tool string.

Preferably there are attachment means to fix the wheels to the axle. Preferably the attachment means is a quick release attachment means so that the wheels can be switched or replaced easily. The attachment means may be a spring action connector so that the wheels provide a 'snap-fit'. Preferably also the wheels may be mounted on the axles so that they turn independently of the axle. In this way each axle may be fixed. A fixed axle advantageously allows a bore to be located through the body and axles so that a central passage is provided on the longitudinal axis through the system.

Preferably the body comprises flared sections facing each end of the narrowed portions. The flared sections provide protection for the wheels when the system enters a restriction in the well bore.

Preferably each pair of wheels are located on the axle such that their hemispherical surfaces describe an ellipse on the first plane. In this way the roller system will preferentially orient to bring the edges onto the low side of the well bore.

Alternatively, each pair of wheels are located on the axle such that their hemispherical surfaces describe a circle on the first plane. In this embodiment the roller sub system further comprises biasing means to orient the wheels within the well bore. The biasing means may be a weight located off-centre in the body. The weight may be provided by a portion of the body being removed, the remaining portion providing the off-set weighting.

Preferably also a swivel is coupled to the body. In this way the system can orient itself in the well bore easily.

According to a second aspect of the present invention there is provided a body for use in a roller sub system, the body comprising an elongate member including connector means for locating the body on a tool string in a well bore, a plurality of narrowed portions on a first plane parallel to a central longitudinal axis of the body through which are located respective axles perpendicular to the longitudinal axis, and each axle including attachment means for mounting a roller wheel thereon.

Preferably the attachment means is a quick release attachment means so that the wheels can be switched or replaced easily. The attachment means may be a spring action connector so that the wheels provide a 'snap-fit'. Preferably also the wheels may be mounted on the axles so that they turn independently of the axle. In this way each axle may be fixed. A fixed axle advantageously allows a bore to be located on the longitudinal axis through the body.

Preferably the body comprises flared sections facing each end of the narrowed portions. The flared sections provide protection for the wheels.

The body may further comprise biasing means to orient the body via the wheels within the well bore. The biasing means may be a weight located off-centre in the body. The weight may be provided by a portion of the body being removed, the remaining portion providing the off-set weighting.

According to a third aspect of the present invention there is provided a roller wheel set for use on a roller sub system, the set comprising a plurality of pairs of wheels, each wheel including an outward facing hemispherical surface with a circumferential edge to contact the well bore wall and means to locate the wheels on opposing ends of an axle.

Preferably the set comprises two pairs of wheels having identical circumferential diameters. Advantageously the set comprises a plurality of pairs of wheels wherein a first plurality of pairs have wheels with a first circumferential diameter and a second plurality of pairs have wheels with a second circumferential diameter. In this way the roller system can be modified for different well bores.

Preferably the attachment means is a quick release attachment means so that the wheels can be switched or replaced easily. The attachment means may be a spring action connector so that the wheels provide a 'snap-fit'.

BRIEF DESCRIPTION OF THE DRAWINGS

Embodiments of the present invention will now be described, by way of example only, with reference to the followings drawings, of which.

DETAILED DESCRIPTION OF THE DRAWINGS

Figure 1:
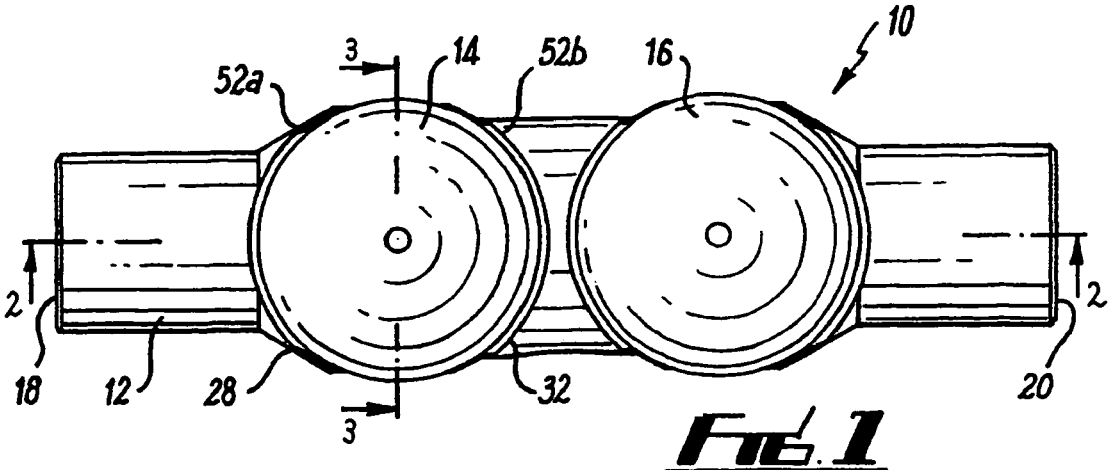
FIG. 1 is a side view of a roller sub system according to a first embodiment of the present invention.
Figure 2:
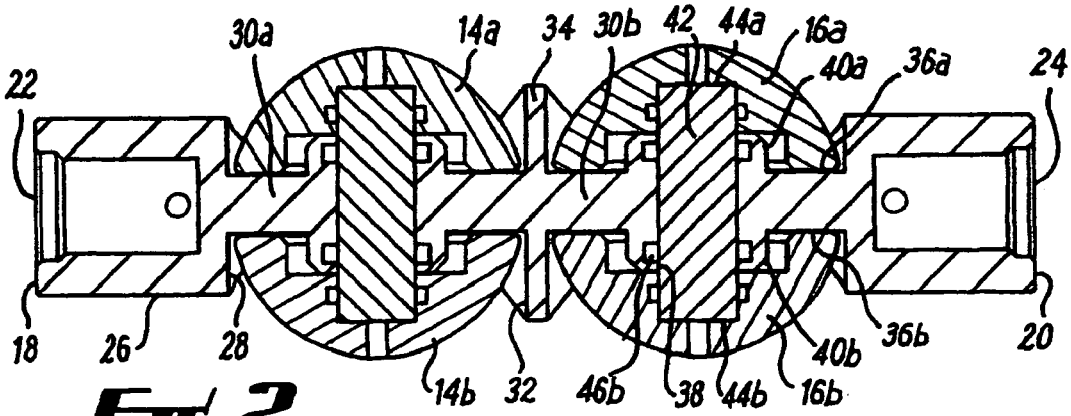
FIG. 2 is a cross-sectional view of the roller sub system of FIG. 1 taken about line 2-2 of FIG. 1.

Reference is initially made to FIGS. 1 to 4 of the drawings which illustrates a roller sub system, generally indicated by reference numeral 10, according to a first embodiment of the present invention. System 10 comprises a body 12 and two pairs of roller wheels 14*a,b* and 16*a,b*.

Body 12 is generally cylindrical having at its ends 18,20 connectors 22,24 to mate with respective connectors of a tool string (not shown). From a first end 18, the body 12 has a cylindrical portion 26, which narrows at a step 28 to provide a narrowed portion 30*a*. The narrowed portion 30*a* is substantially rectangular with a width, in a first plane, which is smaller than the diameter of the cylindrical section 26 and a height greater than the diameter of the cylindrical section 26. The narrowed portion 30*a* is terminated by a second step 32 where the body 12 has an extended cylindrical portion 34 which has a diameter greater than the cylindrical portion 26. The remaining body 12 from the cylindrical portion 34 to the end 20 is a mirror image of the body from the first end 18 at the portion 34.

The narrowed portions 30*a,b* each present parallel faces 36*a,b* perpendicular to the first plane. Centrally through each narrowed portion 30*a,b*, between the faces 36*a,b* is a circular bore 38. A raised circular rim 40*a,b* is provided at the opening of the bore 38 on each face 36*a,b*. Through the bore 38 is located an axle 42. The axle 42 is a cylindrical rod, centrally located within the bore 38 with ends 44*a,b* extending through the rims 40*a,b*. Grease seals 46*a,b* are arranged between the axle 42 and the bore 38 to aid rotation of the axle 42 within the bore 38. The grease seals 46*a,b* are fed via a grease nipple 48 arranged in a port 50 on the extended cylindrical portion 34.

Each narrowed portion 30*a* is terminated by flared sections 52*a,b* of the steps 28,32 respectively. The steps 28,32 with the flared sections 52*a,b* lie on a circle having a centre at the axis of the bore 38 and a diameter greater than the height of the narrowed portion 30*a*.

The roller sub system further comprises the roller wheels 14,16. Each roller wheel 14,16 is identical, being a hemisphere. This provides a curved surface 54 and a rear planar surface 56 which meet at a circumferential edge 58. The edge 58 is rounded to provide a smooth contact surface with a wall of a well bore. A circular recess 60 is provided on the rear surface 56 which provides clearance for the rim 40, so that the wheel 14*a* meets the face 36*a*. A deeper centrally located recess 62 is also provided for locating the wheel 14*a* on the axle 40. The wheel 14*a* is a snap-fit on the axle 40 via canted coil springs 64 which locate in a groove 66 in the recess 62. An access port 68 is also provided through the wheel 14*a* at the centre of the curved surface 54. The port 68 provides access for a screw to mechanically connect the wheel 14*a* to the axle 40.

It should be appreciated that alternative mechanical locking devices may be employed in place of the canted coil springs 64, including those known to the art incorporating screws, pins or locking rings.

The wheels 14,16 are sized such that they fill the narrowed portion 30*a* and the edge 58 has a radius of curvature which is slightly smaller than the radius of curvature of the steps 28,30. This allows the wheel 14,16 to rotate with the axle 40 freely. The wheels 14*a*,16 extend beyond the height of the narrowed portion 30*a*. This prevents contact between the body 12 and the wall of the well bore.

Figure 3:
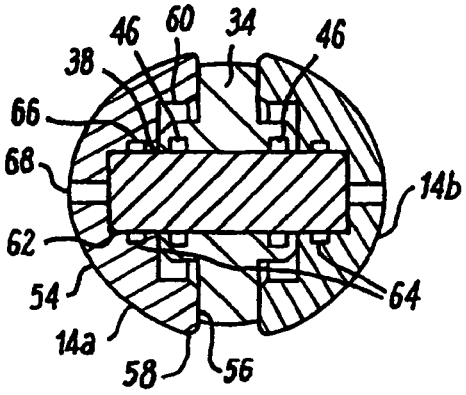
FIG. 3 is a cross-sectional view of the roller sub system of FIG. 1 taken about line 3-3 of FIG. 1.
Figure 4:
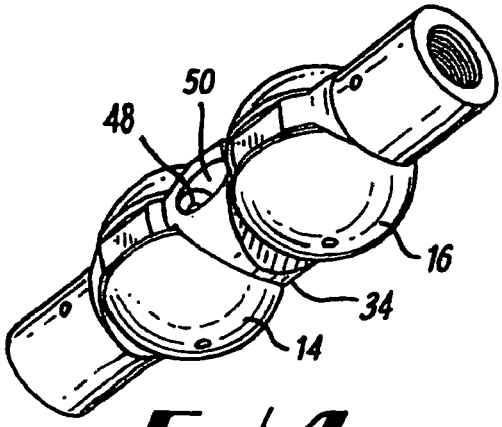
FIG. 4 is a perspective view of the roller sub system of FIG. 1.

Each pair of wheels 14,16, when located on the body 12, provides an elliptical or oval profile to the body 12 in the first plane. This means that the hemispherical surfaces 54 will provide a smaller contact area to the wall of a well bore than the edges 58 and extended portion 34. In this way the roller wheels pairs 14,16 will preferentially roll the sub 10 to a positions as illustrated in FIG. 3 with the edges 58 lowermost.

In use, the roller wheel diameter is selected to be close to, but less than the smallest clearance diameter in the well bore. The selected wheels 14,16 are then clipped onto the axles 40 using the canted coil springs 64. Screws can also inserted through the ports 68 to provide a permanent fixing if required. The axle 40 is greased via the grease nipple 48 so that the wheels 14,16 can rotate freely on the body 12. The roller sub system 10 is then mounted on a tool string using the connectors 22,24 as is known in the art. Any number of roller sub systems can be located on the string and they are typically placed at regular intervals.

The string is then run into a well bore. Any movement of the string from a vertical position will cause the roller wheels to contact the wall of the well bore protecting the string. Further the curvature of the wheels over a hemisphere presents an almost continuous smooth surface to reduce the friction between the string and the wall. If the well deviates towards the horizontal the wheels 14,16 will lie against a low side of the well bore. When this occurs, the system 10 is unbalanced if the edges 58 are not in contact with the low side of the wall. The sub 10 will then tip from a hemispherical surface 54 onto the edges 58 to provide a balanced position. The wheels 14,16 can then drive the sub 10 and string through the well bore. Alternatively or additionally, the wheels 14,16 can rotate to reduce the friction retarding the passage of the sub 10 and string through the well bore.

Figure 5:
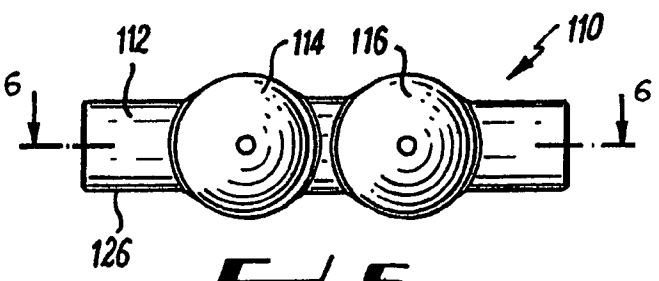
FIG. 5 is a side view of a roller sub system according to a second embodiment of the present invention.
Figure 6:
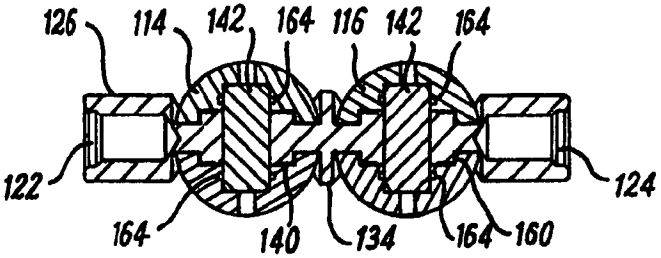
FIG. 6 is a cross-sectional view of the roller sub system of FIG. 5 taken about line 6-6 of FIG. 5.
Figure 7:
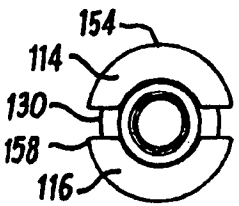
FIG. 7 is an end view of the roller sub system of FIG. 5.

Reference is now made to FIGS. 5 to 7 of the drawings which illustrates an embodiment of a roller sub system, generally indicated by reference numeral 110. The sub system 110 is substantially similar to the sub system 10 of FIGS. 1 to 4 and like parts have therefore been given the same reference numeral with the addition of 100. In this embodiment the extended portion 134 has been retained at a diameter equal to the end portions 126, different connector types 122, 124 have been illustrated and the recess 160 is now a close match to the rim 140. This embodiment operates in an identical manner to the sub 10 of FIGS. 1 to 4.

However, when the tool string requires to enter a section of the well bore with a narrower diameter, the second embodiment can be adapted to reduce the wheel 114,116 diameters. The tool string is first pulled out of the well bore and, without disassembling the string, the wheels 114,116 are pulled off the body 112. The canted coil springs 164 provide a snap-off facility so that it is easy to remove the wheels 114,116 manually. Substitute wheels 214,216 having a smaller diameter are then connected onto the body 112 via the same canted coil springs.

Figure 8:
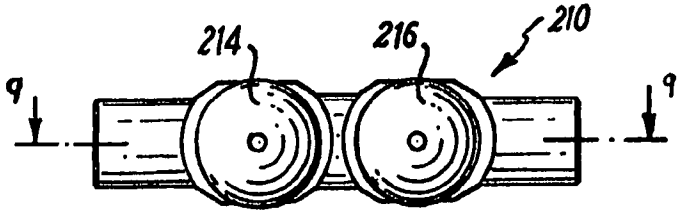
FIG. 8 is a side view of a roller sub system according to a third embodiment of the present invention.
Figure 9:
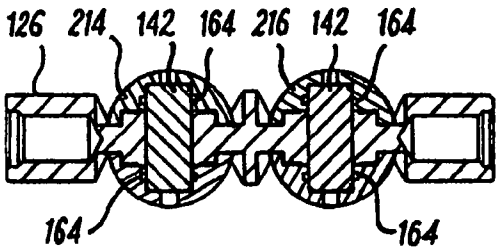
FIG. 9 is a cross-sectional view of the roller sub system of FIG. 8 taken about line 9-9 of FIG. 8.
Figure 10:
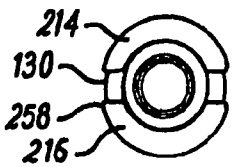
FIG. 10 is an end view of the roller sub system of FIG. 8.

Reference is now made to FIGS. 8 to 10 of the drawings which illustrates a roller sub system, generally indicated by reference numeral 210. Roller sub system 210 is the body 112 of system 110 with smaller wheels 214,216 fitted. As illustrated in FIGS. 7 and 10, the overall diameter of the sub 110,210 is dictated by the diameter of the wheels 114,116, 214,216 used. Thus the sub 210, having smaller wheels can access well bores of narrower cross-section than the sub 110. Conversely, the sub 110 advantageously provides more resistance to wear and a lower coefficient of friction than sub 210. Thus for maximum efficiency the greatest wheel diameter should be used. A roller sub system may therefore be supplied with a single body and a number of pairs of wheels of varying diameters so that a user can adapt the system for use in the well bore at the time.

Figure 11:
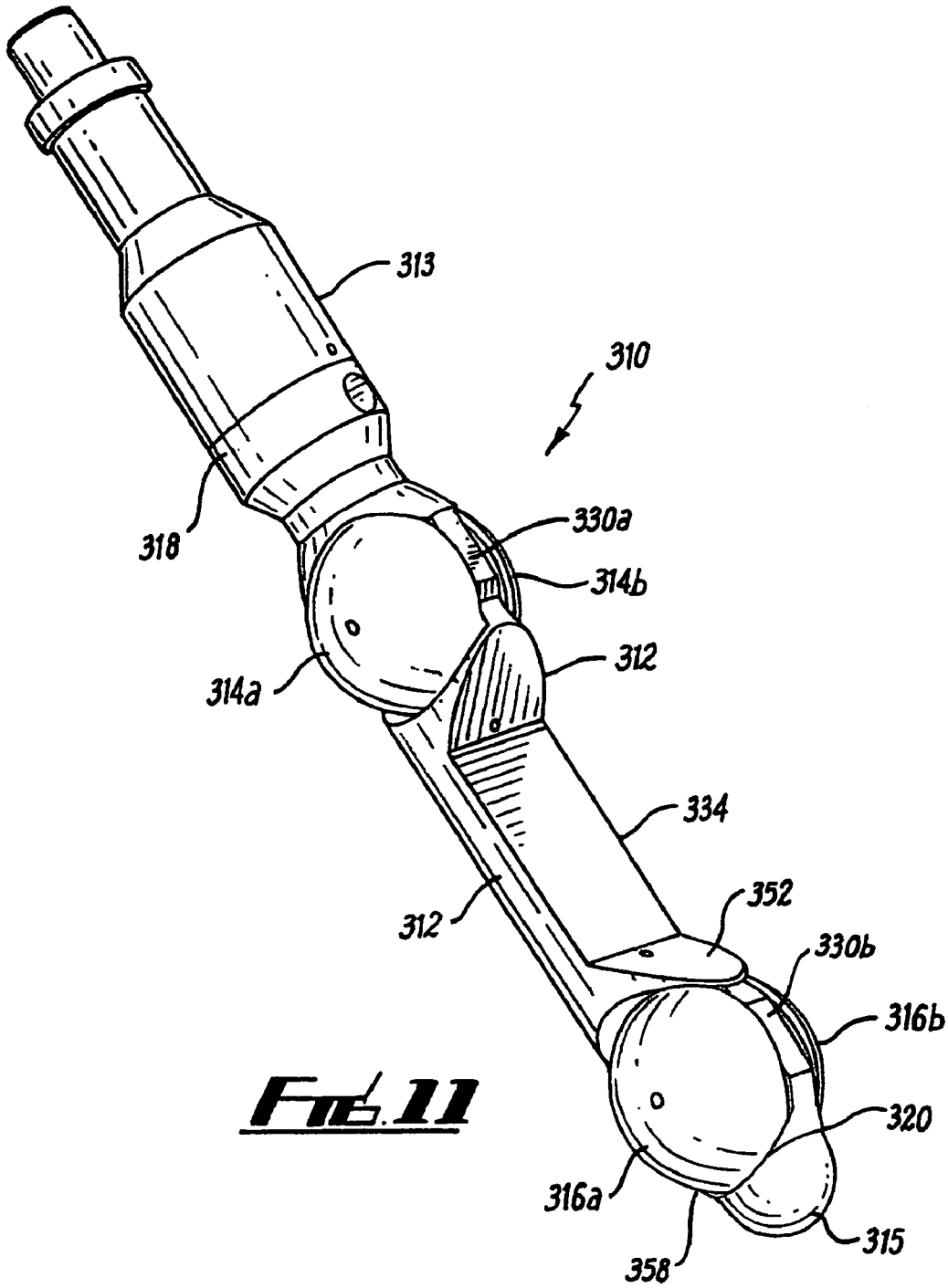
FIG. 11 is a perspective view of a roller sub system according to a fourth embodiment of the present invention.

Reference is now made to FIG. 11 of the drawings which illustrates a roller sub system, generally indicated by reference numeral 310, according to a fourth embodiment of the present invention. Like parts to those of FIGS. 1 to 4 have been given the same reference numeral with the addition of 300. Sub 310 comprises a body 312 on which are located four roller wheels 314,316. The wheels 314,316 are attached to the body 312 via an axle as described hereinbefore with reference to FIG. 1. However, the portion 330 between the wheels 314,316 together with the wheels 314,316 describe a circle in all planes.

The sub 310 is biased to sit with the edges 358 on the low side of the well bore by virtue of loading the body 312 off-centre. In the sub 312 this is achieved through an elongated middle portion 334 between the wheels 314,316. Portion 334 is part cylindrical formed from a cylindrical member with a portion removed from one side. This same effect could be achieved by locating weights asymmetrically within a housing or making the member of combinations of materials.

At a first end 318 of the sub 310 there is a swivel 313 located on the tool string. The swivel 313 allows the sub 310 to rotate relative to the tool string above. At a second end 320, an end piece 315 is attached to illustrate that the sub 310 is suitable for location at any position within a string. It will be appreciated that the end piece 315 could equally be a gauge or other downhole measuring device.

The principle advantage of the present invention is that it provides a roller sub system in which the roller wheels are interchangeable on a single body, while the body can remain in a tool string, so that the largest possible roller diameter can be used for maximum efficiency in a well bore.

A further advantage is that by using hemispherical roller wheels, only the wheels are in contact with the wall of the well bore at all times. Thus wear will only be to the wheels, which are easily replaceable.

It will be understood by those skilled in the art that various modifications may be made to the invention described herein without departing from the scope thereof. For example, any number of pairs of wheels may be located on the body. Further the wheels may rotate with respect to the axles. The axle is then fixed to the narrowed portion. A central bore can be arranged through the body and as such the sub can then accommodate the passage of wireline, fluids or other tools through the bore of the tool string.

We claim:

1. A roller sub system for use in a tool string to reduce friction between the string and a well bore in which the string is run, the system comprising:

an elongate body including connector means for locating the body on the string: and one or more pairs of roller wheels mounted on the body for contacting a wall of the well bore;

wherein the body comprises a plurality of narrowed portions on a first plane parallel to a central longitudinal axis of the body through which are located respective axles perpendicular to the longitudinal axis, a pair of wheels being mounted an each axle;

and wherein each wheel includes an outward facing substantially hemispherical surface with a circumferential edge to contact the well bore wall;

and further wherein each pair of wheels is located on a respective axle such that the hemispherical surfaces of the wheels in each pair describe an ellipse on the first plane.

2. A roller sub system as claimed in claim 1, wherein there are attachment means to fix the wheels to the axle.

3. A roller sub system as claimed in claim 2, wherein the attachment means is a quick release attachment means so that the wheels can be switched or replaced easily.

4. A roller sub system as claimed in claim 1, wherein the wheels are mounted on the axles so that they turn independently of the axle.

5. A roller sub system as claimed in claim 4, wherein the axle is fixed and a bore is located through the body and axles to provide a central passage on the longitudinal axis through the system.

6. A roller sub system as claimed in claim 1, wherein the body comprises flared sections facing each end of the narrowed portions.

7. A roller sub system as claimed in claim 1, wherein each pair of wheels is located on an axle such that their hemispherical surfaces describe a circle on the first plane.

8. A roller sub system as claimed in claim 7, wherein the roller sub system further comprises biasing means to orient the wheels within the well bore.

9. A roller sub system as claimed in claim 8, wherein the biasing means is a weight located off-centre in the body.

10. A roller sub system as claimed in claim 1, wherein the system further comprises a swivel that is coupled to the body so that the system can orient itself in the well bore.

11. A roller sub system as claimed in claim 1, comprising two pairs of wheels having identical circumferential diameters.

12. A roller wheel sub system as claimed in claim 1, wherein a first plurality of pairs of wheels have wheels with a first circumferential diameter and a second plurality of pairs of wheels have wheels with a second circumferential diameter so that the roller system can be modified for different well bores.

* * * * *